US008997880B2

(12) United States Patent
Davis et al.

(10) Patent No.: US 8,997,880 B2
(45) Date of Patent: Apr. 7, 2015

(54) LINED DOWNHOLE OILFIELD TUBULARS

(75) Inventors: Robert H. Davis, Katy, TX (US); Nicholas R. Hennessey, Katy, TX (US)

(73) Assignee: Wagon Trail Ventures, Inc., Humble, TX (US)

( * ) Notice: Subject to any disclaimer, the term of this patent is extended or adjusted under 35 U.S.C. 154(b) by 383 days.

(21) Appl. No.: 13/362,368

(22) Filed: Jan. 31, 2012

(65) Prior Publication Data

US 2013/0192685 A1 Aug. 1, 2013

(51) Int. Cl.
*E21B 19/16* (2006.01)
*E21B 41/00* (2006.01)

(52) U.S. Cl.
CPC ..... *E21B 41/00* (2013.01)

(58) Field of Classification Search
CPC ..... E21B 41/00; F15D 1/00
USPC ..... 166/380, 305.1, 242.1, 242.2
See application file for complete search history.

(56) References Cited

U.S. PATENT DOCUMENTS

| | | | |
|---|---|---|---|
| 3,429,954 | A | 2/1969 | Atkins et al. |
| 3,716,612 | A | 2/1973 | Schrenk |
| 4,048,141 | A | 9/1977 | Doorakian et al. |
| 4,171,560 | A | 10/1979 | Garrett |
| RE31,016 | E | 8/1982 | Oster |
| 4,606,953 | A | 8/1986 | Suzuki et al. |
| 4,852,655 | A | 8/1989 | Guy |
| 4,892,442 | A | 1/1990 | Shoffner |
| 5,048,441 | A | 9/1991 | Quigley et al. |
| 5,069,284 | A | 12/1991 | Gray |
| 5,135,053 | A | 8/1992 | Lowther |
| 5,188,872 | A | 2/1993 | Quigley et al. |
| 5,264,603 | A | 11/1993 | Altes et al. |
| 5,351,752 | A | 10/1994 | Wood et al. |
| 5,435,867 | A | 7/1995 | Wolfe |
| RE35,081 | E | 11/1995 | Quigley |
| 5,472,754 | A | 12/1995 | Doucher et al. |
| 5,511,619 | A | 4/1996 | Jackson |
| 5,590,716 | A | 1/1997 | Mansfield |
| 5,622,210 | A | 4/1997 | Crisman et al. |
| 5,755,266 | A | 5/1998 | Aanonsen et al. |
| 5,849,376 | A | 12/1998 | Oishi et al. |
| 5,921,285 | A | 7/1999 | Quigley et al. |
| 5,933,945 | A | 8/1999 | Thomeer et al. |
| RE36,362 | E | 11/1999 | Jackson |

(Continued)

OTHER PUBLICATIONS

OSHA definition of "well completion", 2001 http://www.osha.gov/SLTC/etools/oilandgas/glossary_of_terms/glossary_of_terms_w.html.

(Continued)

*Primary Examiner* — Yong-Suk (Philip) Ro
(74) *Attorney, Agent, or Firm* — The Elliott Law Firm; Douglas H. Elliott; Sarah J. Kelly

(57) ABSTRACT

A method for providing a string of tubing for installation in a well, which method comprises installing a string of tubing within a wellbore. The string of tubing comprises a plurality of elongated tubular members and at least one cylindrical liner comprising a polymer. At least one of the plurality of elongated tubular members includes a cylindrical wall having an inner surface and an outer surface. The cylindrical liner has an outer surface that is disposed in adjacent contact with the inner surface of the elongated tubular member. The cylindrical liner has an inner surface that defines the tubing borehole through which fluids are capable of flowing. The cylindrical liner has a scrolled configuration.

2 Claims, 4 Drawing Sheets

(56) References Cited

U.S. PATENT DOCUMENTS

| | | | | |
|---|---|---|---|---|
| 6,004,639 | A | 12/1999 | Quigley et al. | |
| 6,016,845 | A | 1/2000 | Quigley et al. | |
| 6,062,996 | A | 5/2000 | Quigley et al. | |
| 6,065,540 | A | 5/2000 | Thomeer | |
| 6,079,959 | A | 6/2000 | Kingsford et al. | |
| 6,148,866 | A | 11/2000 | Quigley et al. | |
| 6,170,535 | B1 | 1/2001 | Sadr et al. | |
| 6,177,516 | B1 | 1/2001 | Hudak | |
| 6,286,558 | B1 | 9/2001 | Quigley et al. | |
| 6,312,637 | B1 | 11/2001 | Evans et al. | |
| 6,357,485 | B2 | 3/2002 | Quigley et al. | |
| 6,361,299 | B1 | 3/2002 | Quigley et al. | |
| 6,422,269 | B1 | 7/2002 | Johansson et al. | |
| 6,447,858 | B1 | 9/2002 | Shimo et al. | |
| 6,527,015 | B2 | 3/2003 | Lively | |
| 6,585,049 | B2 | 7/2003 | Leniek, Sr. | |
| 6,604,550 | B2 | 8/2003 | Quigley et al. | |
| 6,663,453 | B2 | 12/2003 | Quigley et al. | |
| 6,684,910 | B2 | 2/2004 | Stoffelsma et al. | |
| 6,706,348 | B2 | 3/2004 | Quigley et al. | |
| 6,764,365 | B2 | 7/2004 | Quigley et al. | |
| 6,857,452 | B2 | 2/2005 | Quigley et al. | |
| 6,978,804 | B2 | 12/2005 | Quigley et al. | |
| 7,029,356 | B2 | 4/2006 | Quigley et al. | |
| 7,069,955 | B2 | 7/2006 | Glejbol et al. | |
| 7,096,890 | B2 | 8/2006 | Woolstencroft et al. | |
| 7,134,495 | B2 | 11/2006 | Vloedman et al. | |
| 7,152,632 | B2 | 12/2006 | Quigley et al. | |
| 7,234,410 | B2 | 6/2007 | Quigley et al. | |
| 7,740,077 | B2 * | 6/2010 | Davis | 166/381 |
| 2001/0021426 | A1 | 9/2001 | Procida et al. | |
| 2001/0029989 | A1 | 10/2001 | Paz | |
| 2002/0066491 | A1 | 6/2002 | Lively | |
| 2003/0121559 | A1 | 7/2003 | Glejbol et al. | |
| 2003/0213596 | A1 | 11/2003 | Davis | |
| 2003/0232207 | A1 | 12/2003 | Thullen et al. | |
| 2004/0118468 | A1 | 6/2004 | Mestemacher | |
| 2005/0115717 | A1 * | 6/2005 | Hall et al. | 166/380 |
| 2005/0181162 | A1 | 8/2005 | Mestemacher et al. | |
| 2005/0229991 | A1 | 10/2005 | Hardy et al. | |

OTHER PUBLICATIONS

Derwent Abstract for US 4048141.

* cited by examiner

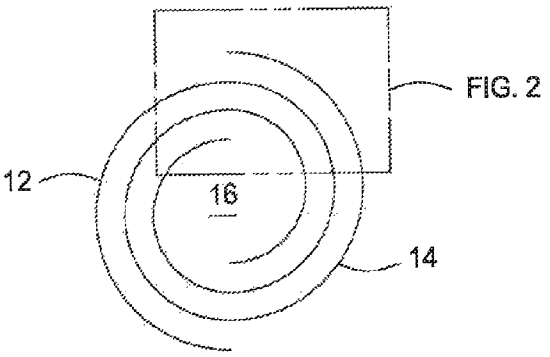
FIG. 1
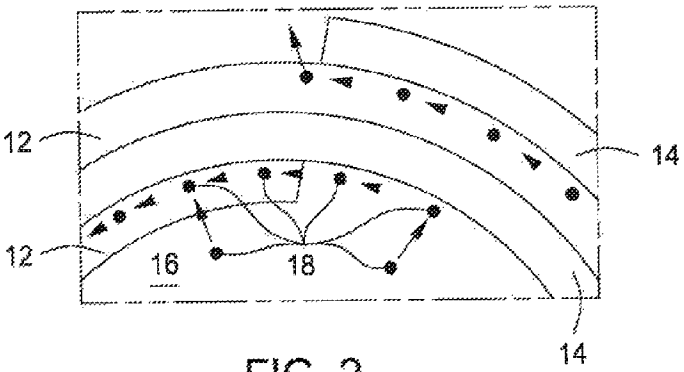
FIG. 2
FIG. 3
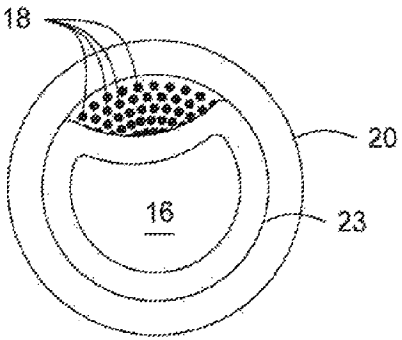
FIG. 4

LINED DOWNHOLE OILFIELD TUBULARS

BACKGROUND

1. Field of Inventions

The field of this application and any resulting patent is lined downhole oilfield tubulars.

2. Description of Related Art

Downhole tubulars have been used in the past to produce oil from underground reservoirs including free flowing, reciprocating rod pumped, plunger lifted, gas lifted, submersible pumped, progressive cavity pumped, and hydraulically lifted methods. Other uses have included source, injection or disposal tubulars used to transport corrosive gases and fluids such as water and/or carbon dioxide ($CO_2$) either for disposal or in secondary recovery operations.

Historically, wells using conventional reciprocating rod pumping units, rotating progressive cavity pumps, or plunger lift units in particular have evidenced problems with tubing and/or production equipment due to abrasion of the moving parts of the artificial lift devices (for example: rods, rod couplings and plungers) on the tubing walls. These failures may be accelerated by the presence of corrosive elements and/or by the deviation of the well bore. The production tubing joints can be protected with various corrosion resistant organic coatings to protect these areas from corrosive attack. A polymer liner greatly reduces these failures.

Tubular goods, such as oil country tubular goods ("OCTG's") (e.g., well casing, tubing, drillpipe, drill collars, and line pipe) and flowline tubular goods, have been used for transportation of gases, liquids, and mechanical equipment, including various applications related to extraction of petroleum and natural gas from underground reservoirs, transportation of petroleum, natural gas, and other materials, such as solution mining and slurry transport lines in the mining industry. OCTG's have been used to transport the product from the underground reservoir, and also to house mechanical equipment (e.g., artificial lift devices, rod couplings, plungers, reciprocating rod pumping units, rotating progressive cavity pumps, and plunger lift units), electrical equipment (e.g., well monitoring equipment), and/or transport gases or liquids for disposal operations or secondary removal operations. These gases and liquids may contain corrosive materials such as, by way of example only, salt water, dissolved oxygen, $CO_2$, or $H_2S$. In addition, flowline tubular goods have been used to transport petroleum, petroleum products, natural gas, or other gases or liquids from one point to another. The gases and liquids which flow within flowlines may comprise corrosive and/or abrasive components. In addition, flowline tubular goods have occasionally required the use of mechanical equipment, such as pigs, to clean or service the tubular goods.

With respect to moving mechanical equipment and abrasive fluids, such as reciprocating or rotating rods or pumps or drilling or mining slurries (e.g., drilling mud), friction and abrasion may cause wear, fatigue, and even failure of the pipe and/or the equipment. In addition, this wear, fatigue, or failure may be accelerated due to the presence of corrosive or abrasive materials, such as, for example $CO_2$, or by deviations in the direction of the well bore.

In addition to the possible acceleration of mechanical wear, fatigue, and failure, the presence of corrosive materials, in and of itself, may cause chemical damage to the OCTG's and flowline tubular goods. By way of example only, the presence of $CO_2$, when contacted with metal or other materials, may cause corrosion, dusting, rusting, or pitting, which may lead to failure of the metal or material. In addition, the presence of microbiological active agents, such as bacteria, may produce chemicals that influence or accelerate corrosion.

It would therefore be desirable to create tubular goods that decrease or eliminate the mechanical and/or chemical wear, fatigue, or failure caused by the conditions surrounding the extraction of materials such as petroleum or natural gas and transportation of materials, thereby potentially increasing the life and productivity of those tubular goods.

Various methods and devices have been proposed and utilized, including the methods and devices disclosed in the patents appearing on the face of this patent. However, these methods and devices lack all the steps or features of the methods and devices covered by the patent claims below, and the methods and structures claimed in this issued patent solve many of the problems found in many of the methods and structures in those earlier patents, have unpredictable benefits, and overcome shortcomings inherent in those earlier methods and structures.

SUMMARY

One or more specific embodiments disclosed herein includes a method for providing a string of tubing for installation in a well, which method comprises installing a string of tubing within a wellbore, wherein the string of tubing comprises a plurality of elongated tubular members and at least one cylindrical liner comprising a polymer; at least one of the plurality of elongated tubular members includes a cylindrical wall having an inner surface and an outer surface; the cylindrical liner has an outer surface that is disposed in adjacent contact with the inner surface of the elongated tubular member; the cylindrical liner has an inner surface that defines the tubing borehole through which fluids are capable of flowing; and the cylindrical liner has a scrolled configuration.

BRIEF DESCRIPTION OF THE DRAWINGS

FIG. 1 is a simplified representation of an end-on cross section of a scrolled liner.

FIG. 2 is an inset of FIG, 1 showing representative movement of simulated gas molecules through a cross section of a scrolled liner.

FIG. 3 is a cross section of a non-scrolled liner positioned within a section of tubing that also shows representative movement of simulated gas molecules through the liner.

FIG. 4 is a cross section of a non-scrolled liner positioned within a section of tubing that shows gas build-up causing the liner to collapse within the tubing.

DETAILED DESCRIPTION

1. Introduction

Figure 5:
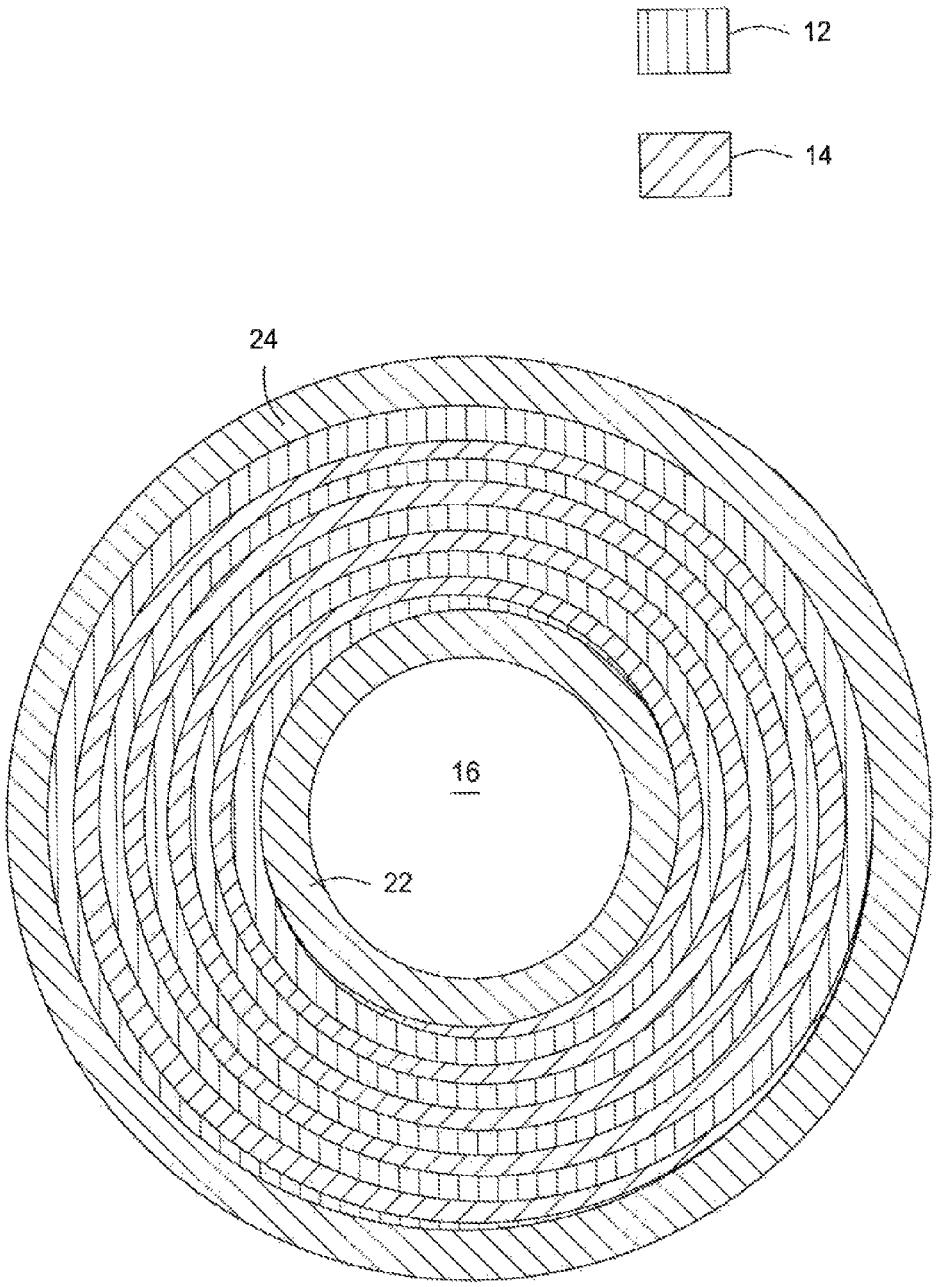
FIG. 5 is an end-on cross section of a scrolled cylindrical liner.

A detailed description will now be provided. The purpose of this detailed description, which includes the drawings, is to satisfy the statutory requirements of 35 U.S.C §112. For example, the detailed description includes disclosure of the inventors' best mode of practicing the inventions, a description of the inventions, and sufficient information that would enable a person having ordinary skill in the art to make and use the inventions referenced in the claims. In all the figures, like elements are indicated by like reference numerals regardless of the view in which the elements appear. The figures are intended to assist the description and to provide a visual representation of certain aspects of the subject matter described herein. Those figures are not drawn to scale, nor are they intended to show all the structural details of the methods and apparatus, nor to limit the scope of the claims.

Each of the appended claims defines a separate invention, which for infringement purposes is recognized as including equivalents of the various elements or limitations specified in the claims. Depending on the context, all references below to the "invention" may in some cases refer to certain specific embodiments only and not others. In other cases, it will be recognized that references to the "invention" will refer to the subject matter recited in one or more, but not necessarily all, of the claims. Each of the inventions will now be described in greater detail below, including specific embodiments, e.g., versions and examples, but the inventions are not limited to these embodiments, versions, or examples, which are included to enable a person having ordinary skill in the art to make and use the inventions, when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below, or in representations to the PTO, it should be given the broadest definition persons in the pertinent art have given that term as reflected in printed publications, dictionaries, and issued patents.

2. Selected Definitions

Certain claims include one or more of the following terms, which, as used herein, are expressly defined as follows.

The term "scrolled" is defined herein as being circumferentially disposed about a fixed point or axis and having increasing or decreasing radial distances relative to the fixed point or axis, preferably such that at least some amount of overlap of the thing that is scrolled (e.g., a sheet or layer) occurs after travelling circumferentially more than 360 degrees. For example, a single sheet layer may be circumferentially disposed about a center axis in gradually increasing or decreasing distances from the center axis to form one or more "scroll layers." Thus, in an alternative embodiment, a single sheet layer may be circumferentially disposed around a center axis in gradually increasing or decreasing distances to form a first full scroll layer (over 360 degrees) plus a second partial scroll layer (e.g., an additional 90 degrees). Preferably, at least two adjacent layers (e.g., which may be laminated together before scrolling or co-extruded in adjacent co-cylindrical relation) may be scrolled together in a way that a circumference is comprised of at least one iterance (360 degrees) of each layer. Preferably, as the multiple layers are scrolled together, each layer does not come in contact with itself after spanning the circumference. Rather, when a radial cross section of the circumference is considered, a different layer is preferably located between each iterance of any layer.

The term "scroll layer" is defined herein as a layer that is a part of and serves to define a scrolled object. A full scroll layer may be at least one sheet layer that is circumferentially disposed a total of slightly over 360° around a center axis in increasing or decreasing distances from the center axis and does not start and end at the same radial distance; rather, the end position will be radially closer or farther from the start position, so that the scroll layer is not perfectly circular (or cylindrical) in shape. The tangent line drawn from any point on a scroll layer is preferably not perpendicular to a line drawn from the same point to the center axis. The end position need not be the edge of the sheet layer. Circumferentially disposing a sheet layer greater than 360° around a center axis in increasing or decreasing distances from the center axis may result in an additional full or partial scroll layer. A partial scroll layer may be a sheet layer that is circumferentially disposed less than 360° around a center axis, although for a sheet layer to form the first scroll layer, the sheet layer must be circumferentially disposed at least 360°. Thereafter, any additional scroll layer may have a circumference of less than 360°. A single sheet layer circumferentially disposed 720° about a center axis may be defined as having two scroll layers, which would be two overlapping scroll layers that are connected. A single sheet layer circumferentially disposed 540° about a center axis may create one full scroll layer and a second partial scroll layer that are both overlapping and connected. Preferably, multiple scroll layers are approximately co-axial. Two sheet layers starting at opposite points from a center axis may be circumferentially disposed 270° to create one full scroll layer and a partial (i.e. half of a) scroll layer, provided that each sheet layer has a portion where it is radially inside the other sheet layer and has a portion where it is radially outside the other sheet (i.e. each sheet overlaps the other). Two sheet layers starting at opposite points from a center axis may be circumferentially disposed 360° to create two full scroll layers, provided that each sheet layer has a portion where it is radially inside the other sheet layer and has a portion where it is radially outside the other sheet (i.e. each sheet overlaps the other). The ends of each of the sheet layers should also not start and end at the same spatial position after travelling 360°; rather, the end position will be radially closer or farther from the start position.

The term "sheet layer" is defined herein as an elongated structure capable of forming a partial scroll layer, a full scroll layer, or multiple scroll layers. A sheet layer may be extruded to form one or more scroll layers, e.g., a full scroll layer, multiple scroll layers, or full-plus-partial scroll layer(s). A sheet layer may be circumferentially disposed to form a partial scroll layer, a full scroll layer, or multiple scroll layers. A single sheet layer may be circumferentially disposed more than 360° to form multiple scroll layers. Multiple sheet layers may be scrolled together to form multiple scroll layers. For example, two sheet layers may be scrolled 720° starting from the same point to form four scroll layers across any radius. In another example, two sheet layers may be scrolled 540° starting from different points opposite (about 180° apart) one another to form 3 scroll layers when counted across any radius. In another example, two sheet layers may be scrolled 540° starting from the same point to form two scroll layers across some radii, and four scroll layers across other radii. Preferably, multiple sheet layers formed into multiple scroll layers are approximately co-axial. A sheet layer may have different chemical and/or physical properties than another sheet layer. For example, one sheet layer may be formed of a gas diffusion material, and another sheet layer may be formed of a gas diffusion barrier material. A sheet layer may be a continuous structure that is capable of being circumferentially disposed partway, one time, or multiple times around a center axis, e.g., in an approximately cylindrical configuration to form a tubular liner that can be disposed inside an oilfield production tubular.

The terms "gas diffusion" and "gas diffusion barrier" are used herein as relative terms, such that any "gas diffusion" layer, material, or structure is defined herein as a layer, material, or structure that is capable of permitting gas molecules to diffuse or otherwise flow through at a rate that is higher than the rate through which the same gas molecules flow through the same gas diffusion barrier layer, material, or structure (e.g., having the same composition, density and thickness)

under the same conditions, e.g., temperature, pressure, etc. For example, non-gas diffusion barrier of the same size in the same environment. In the context of a gas diffusion layer (also referred to herein as "diffusion layer") and a gas diffusion barrier layer (also referred to herein as "barrier layer"), the term "gas permeability" may be used interchangeably with "diffusion" A variety of test methods may be used to measure or otherwise quantify the diffusion or permeability rate of a particular diffusion or diffusion barrier layer referenced herein. However, at least one acceptable or illustrative method for measuring diffusion or gas permeability herein is the test procedure in the ASTM D1434-82(2009). The diffusion rate of a barrier layer need not be a zero value. A gas barrier layer may comprise an alcohol, preferably a vinyl alcohol. A gas diffusion barrier may comprise a polymer, preferably polyvinyl alcohol. A gas diffusion barrier that inhibits easy or rapid diffusion, even under high pressure, may direct the movement of gas molecules along its surface. Consequently, as discussed in greater detail below, a scrolled 2-layer liner composed of one barrier layer and one diffusion layer may provide a scrolled path for gas molecules to move circumferentially from the interior of the scrolled liner (closer to the axis) to the exterior (farther away from the axis).

The term "providing" is defined herein as supplying, making available, or furnishing. For example, a manufacturer may provide an object that did not previously exist. Also, for example, a supplier may provide an object by shipping or moving it from one location to another. Additionally, for example, an installer may provide an object for use. Providing does not have to include manufacturing as well as installing an object; rather, these providing acts may be viewed as two separate instances of providing the object.

The term "rigid" is defined herein as having the broadest possible definition, as being substantially inflexible when normal human pressure is applied to it. But when one material (e.g., a metal) is described herein as being "rigid" and another material exists or is identified in the same context but is not described as "rigid," then the "rigid" material is regarded as being more rigid than the other material. Thus, for example, when a metal is described as "rigid," then any polymer liner is considered to be less rigid. Thus, anything "rigid" may also be described as unyielding, stiff, or inflexible, A rigid structure is one that may not be substantially structurally compromised by human hands. A rigid tubular member may not be substantially structurally compromised in an environment where pressure on the member is at least 10 psia and may be up to or over 100 psia. A rigid tubular member may not be substantially structurally compromised in an environment where temperatures are at least 15 degrees Celsius to over 100 degrees Celsius.

The term "borehole" is defined herein as a hollow, elongated, substantially cylindrical cavity positioned underground. A borehole may be a cavity formed from removing a section of earth, e.g., by a drilling operation. A borehole may also be a hollow inner cavity of a tubular member that is located underground. A borehole may comprise an inner surface capable of being covered by a liner. Several tubular members may be combined to form a single unit comprising a single borehole. A tubular member may be covered with a liner, and the inner cavity of the liner may define a borehole. Several tubular members may be combined to form a single unit, and at least one liner may cover the tubular members, and the inner cavity of the liner or liners may comprise a single borehole. Several separate tubular members may comprise multiple boreholes. Several separate members covered with liners may comprise several boreholes.

The term "liner" is defined herein as a structure, preferably elongated and cylindrical, that is capable of covering the surface of another object, e.g., the inside surface of an oilfield. tubular. A preferred liner for purposes of the claims herein is a liner having a scrolled configuration (which may also be referred to herein simply as a "scrolled liner"). Such a scrolled liner may be manufactured or otherwise prepared or assembled in many ways, using a number of different techniques, equipment and materials that are known by persons skilled in the art of making tubular-shaped products or pipes and, unless indicated otherwise herein, there is no intention to restrict the process for making the scrolled liner. The layer(s) forming the liner can be physically wound into a scrolled configuration, or they can be extruded into a scrolled configuration, e.g., using appropriate die equipment. For example, one or more sheet layers can be prepared separately (e.g., by extrusion) and then wound about a central axis to form a scrolled liner having one or more scroll layers. Alternatively, a laminated composite layer that is composed of individual sub-layers may be extruded into that laminated/scrolled configuration. Preferably, a liner protects much of the inner surface of the tubular from exposure to the environment inside the wellbore through which either injection fluids are passed (in an injection. well) or production fluids, e.g., oil or gas, are removed (in a production well). Preferably, a liner is disposed on the interior surface of another object. Preferably, a liner serves to protect another object's surface from damage. A liner may be cylindrical or tubular. A liner may conform to the shape of the object it is covering, which may or may not be cylindrical. A liner may comprise a single layer or multiple layers or elements. A liner may comprise multiple scrolled layers or elements. A liner may comprise multiple scrolled and non-scrolled layers or elements. A liner need not be covering another object, but may be capable of covering another object. A "liner" as that term is used herein may include a single layer or it may include multiple layers, and it may include a gas diffusion material, a gas diffusion barrier material, an adhesive material and/or a friction and/or wear reducing material, or any combination of two or more of the previous materials.

The term "polymer" is defined herein broadly as a molecule formed from repeating structural units, preferably carbon atoms that are interconnected with single or double bonds, with optional functional groups. A polymer may be broadly defined as any material comprising these molecules, preferably a plastic. A polymer that is used as a liner material herein preferably has a lower coefficient of friction than that of any metal object. Certain polymers used to form any of the liners discussed herein are gas diffusion materials while others are diffusion barrier materials. A polymer may be a homopolymer, comprised of a single type of repeat unit. A polymer may be a copolymer, comprised of a mixture of repeat units, Examples of polymers include, but are not limited to, polyolefin, polypropylene, polyethylene, and polyvinyl alcohol.

The term "layer" is defined herein as having the broadest definition used in the plastics industry, and as being a physical object having a planar, cylindrical, or tubular form, or at least capable of forming a plane or a cylinder or a tubular shape, and also as being capable of at least partially covering another surface, e.g., the inner surface of a pipe. The thickness of the layer need not be uniform throughout the entire layer. A layer of a material preferably has the same chemical properties throughout the entire layer. A layer may have the same physical properties throughout the entire layer. Two directly adjacent layers comprised of a single material having the same chemical properties may be considered either two layers or a single layer having their combined thickness.

The term "adhesive" is defined herein as any material that is capable of causing the physical or chemical bonding of two objects or adjacent surfaces, or is capable of enhancing the ability of two objects or adjacent surfaces to bond. An adhesive layer is a layer that may be placed between two other layers that are each adjacent to the adhesive layer and serves to bond the two layers together, e.g., such that all three layers may be "sandwiched" together. For example, an adhesive layer may be placed between a gas diffusion barrier layer and a gas diffusion layer, so that the gas diffusion barrier layer and the gas diffusion layer are bonded together. Also, for example, an adhesive layer may be placed between a gas diffusion barrier and a friction and wear reducing layer, so that the gas diffusion barrier and a friction and wear reducing layer are bonded together. Further, for example, an adhesive layer may be placed between a gas diffusion layer and a friction and wear reducing layer, so that the gas diffusion layer and a friction and wear reducing layer are bonded together.

The term "adhesive additive" is defined herein as a substance that has an "adhesive" quality, and that is capable of being mixed with another substance (e.g., a polymer that forms a first layer) such that the combination of the adhesive additive and the other substance (e.g., the polymer) is more likely to bond together with another object (e.g., a second polymer layer). The adhesive additive does not necessarily need to be or form a separate adhesive layer, but rather may be part of one of the other layers in a multi-layered liner. For example, an adhesive additive may be mixed with a gas diffusion material to form a gas diffusion layer; such that the gas diffusion layer is more likely to bond with a gas diffusion barrier layer than if the gas diffusion layer did not include the adhesive additive.

The term "bond together" is defined herein broadly as meaning to hold, join, or connect together. Two materials layers) may "bond together" chemically or physically, or some combination of physical or chemical bonding. "Bond together" may also include causing to become more difficult to separate than non-bonded elements. Two objects that are bonded together may be, but are not necessarily, inseparable. For example, an adhesive may be used to bond together two objects. For example, an adhesive layer may be used to bond together two other layers. For example, an adhesive additive may be used to cause one object to bond to another object.

The term "circumferentially" is defined herein as a manner that encircles, so as to surround, or in a curved manner. Preferably, as used herein, travelling circumferentially does not involve a path that forms a perfect circle; rather, the path may form a scroll, where the path's end point is radially farther or closer to the path's starting point. A circumferential path may involve only a partial rotation (i.e. <360°) around a center point or axis. Circumferential motion may involve a full rotation (i.e. 360°) or more (i.e. >360°) around a center point or axis. Circumferential motion is preferably curved in a single direction (clockwise or counterclockwise) and may not change to travel in the opposite direction.

The term "friction reducing layer" also referred to herein as a "friction and wear reducing layer" is defined herein as any layer of material that causes reduction in friction. For example, a friction reduction layer, when positioned between two objects (or substances), may serve to reduce the coefficient of friction between those two objects or substances, reduce the rate of deterioration of at least one of the two objects, or both reduce the coefficient of friction between two objects and reduce the rate of deterioration of at least one of the two objects. Also, for example, a "friction reducing layer" in a liner is any layer whose surface has a lower coefficient of friction relative to a fluid passing over the surface than the coefficient of friction provided by any other layer in that same liner; thus, a "friction reducing layer" is a relative term. Also, for example, a friction and wear reducing layer may be positioned as an innermost layer of a liner and form the borehole of the liner. The friction and wear reducing layer may then serve to reduce flow friction of the liquid traveling within the liner and may also protect a tubular member the liner is positioned in from wear due to corrosive elements. For example, a friction and wear reducing layer may be positioned as an outermost layer of a liner and form an outside surface of the liner. The outside surface of the liner positioned within a tubular member may then. serve to reduce friction due to movement of the tubular member relative to a second tubular member containing the first tubular member. A friction and wear reducing layer may comprise a polymer, preferably polyethylene or polypropylene.

3. Certain Specific Embodiments

Now, certain specific embodiments are described, which are by no means an exclusive description of the "invention," Other specific embodiments, including those referenced in the drawings, are encompassed by this application, and any patent that issues therefrom.

A. Methods and Apparatus for Providing a String of Tubing for Installation

One or more specific embodiments herein includes a method for providing a string of tubing for installation in a well, which method preferably comprises installing a string of tubing within a wellbore, wherein the string of tithing comprises a plurality of elongated tubular members and at least one cylindrical liner comprising a polymer; at least one of the plurality of elongated tubular members includes a cylindrical wall having an inner surface and an outer surface; the cylindrical liner has an outer surface that is disposed in adjacent contact with the inner surface of the elongated tubular member; the cylindrical liner has an inner surface that defines the tubing borehole through which fluids are capable of flowing; and the cylindrical liner has a scrolled configuration.

In any of the methods or apparatus disclosed herein, the cylindrical liner preferably includes a layer that is scrolled circumferentially such that at least a portion of the layer overlaps another portion of the layer.

In any of the methods or apparatus disclosed herein, the cylindrical liner preferably includes at least one scroll layer.

In any of the methods or apparatus disclosed herein, the cylindrical liner preferably includes at least two single sheet layers that are scrolled to form the scrolled configuration that includes at least one full scroll layer.

In any of the methods or apparatus disclosed herein, the cylindrical liner preferably includes at least two single sheet layers that are scrolled to form the scrolled configuration, and the elongated tubular members are more rigid than the polymer liner.

In any of the methods or apparatus disclosed herein, the cylindrical liner preferably includes at least two single sheet layers that are scrolled to form the scrolled configuration, and at least one of the single sheet layers comprises a thermoplastic.

In any of the methods or apparatus disclosed herein, the cylindrical liner preferably includes at least two single sheet layers that are scrolled to form the scrolled configuration, and at least one of the single sheet layers comprises a polyolefin.

In any of the methods or apparatus disclosed herein, the cylindrical liner preferably includes at least two single sheet layers that are scrolled to form the scrolled configuration and at least one of the single sheet layers is a gas diffusion barrier layer.

In any of the methods or apparatus disclosed herein, the cylindrical liner preferably includes at least two single sheet layers that are scrolled to form the scrolled configuration and at least one of the single sheet layers comprises vinyl alcohol, vinyl acetate, or both vinyl alcohol. and vinyl acetate.

In any of the methods or apparatus disclosed herein, the cylindrical liner preferably includes at least two single sheet layers that are scrolled to form the scrolled configuration and at least one of the single sheet layers is a friction-reducing layer.

In any of the methods or apparatus disclosed herein, the cylindrical liner preferably comprises at least three single sheet layers that are scrolled to form the scrolled configuration and at least one of the single sheet layers is an adhesive layer.

In any of the methods or apparatus disclosed herein, the cylindrical liner preferably comprises at least three single sheet layers that are scrolled to form the scrolled configuration and at least one of the single sheet layers is an adhesive layer, which adhesive layer bonds together two other layers of the liner.

In any of the methods or apparatus disclosed herein, the cylindrical liner preferably includes at least one sheet layer that is scrolled to form the scrolled configuration and a non-scrolled, cylindrical layer positioned as the radially innermost layer of the cylindrical liner.

In any of the methods or apparatus disclosed herein, the cylindrical liner preferably includes at least one sheet layer that is scrolled to form the scrolled configuration and a non-scrolled, cylindrical layer positioned as the radially outermost layer of the cylindrical liner.

In any of the methods or apparatus disclosed herein, the cylindrical liner preferably further comprises an adhesive additive.

In any of the methods or apparatus disclosed herein, at least one elongated rigid tubular member preferably comprises metal and the inner surface of the elongated rigid tubular member preferably comprises an inner metallic surface and the outer surface of the elongated rigid tubular member preferably comprises an outer metallic surface, In any of the methods or apparatus disclosed herein, the cylindrical liner is preferably between 2 and 50 mm thick.

In any of the methods or apparatus disclosed herein, the cylindrical liner is preferably exposed to temperatures of over 15 degrees Celsius.

In any of the methods or apparatus disclosed herein, the cylindrical liner is preferably exposed to temperatures of over 100 degrees Celsius.

In any of the methods or apparatus disclosed herein, the cylindrical liner is preferably between 20 and 700 mm in diameter.

B. Specific Oilfield Methods and Apparatus

One or more of the downhole oilfield tubular apparatus includes a rod pumping system and a plurality of sucker rods disposed within a string of tubing that comprises a plurality of tubing sections each having a tubular borehole and an inside diameter; and a downhole pump operably connected to the sucker rods; wherein the one or more tubing sections has one or more of the liners disclosed herein disposed within the tubular borehole of the one or more tubing sections.

One or more of the downhole oilfield tubular apparatus that is or includes a progressive cavity pumping system includes a plurality of sucker rods disposed within a string of tubing that comprises one or more tubing sections each having a tubular borehole and an inside diameter; and a downhole pump operably connected to the sucker rods; wherein the one or more tubing sections has one or more of the liners disclosed herein disposed within the tubular borehole of the one or more tubing sections.

One or more of the downhole oilfield tubular apparatus that is or includes a downhole reservoir pressure well capable of being openly produced to facilitate lifting fluids, solids or gases to the surface includes a string of tubing that comprises one or more tubing sections each having a tubular borehole and an inside diameter; wherein the one or more tubing sections has one or more of the liners disclosed herein disposed within the tubular borehole of the one or more tubing sections.

One or more of the downhole oilfield tubular apparatus that is or includes a plunger lifted system that includes a cylindrical object capable of raising fluids to the surface of the ground includes a receiver for the plunger cylinder that includes a string of tubing comprising one or more tubing sections each having a tubular borehole and an inside diameter wherein the one or more tubing sections has one or more of the liners disclosed herein disposed within the tubular borehole of the one or more tubing sections.

One or more of the downhole oilfield tubular apparatus includes a submersible pump that includes a downhole impeller driven pump and a string of tubing comprising one or more tubing sections each having a tubular borehole and an inside diameter wherein the one or more tubing sections has one or more of the liners disclosed herein that includes a polymer disposed within, the bore of the tubing section.

In one or more of the downhole oilfield tubular apparatus the submersible pump is a jet pump.

In one or more of the downhole oilfield tubular apparatus the submersible pump is a hydraulic pump.

In one or more of the downhole oilfield tubular apparatus the submersible pump is an electric submersible pump.

One or more of the downhole oilfield tubular apparatus includes a gas lifted system that includes a set of downhole mandrels deployed within a tubing string for injecting gas into a produced fluid and a string of tubing comprising one or more tubing sections each having a tubular borehole and an inside diameter wherein the one or more tubing sections has one or more of the liners disclosed herein disposed within the tubular borehole of the one or more tubing sections.

Also disclosed are methods of using one or more of the downhole oilfield tubular apparatus disclosed herein that includes injecting fluids or gases into the apparatus for enhanced recovery of natural resources in a downhole formation.

Also disclosed are methods of using one or more of the downhole oilfield tubular apparatus disclosed herein wherein the injected fluids or gases include water.

Also disclosed are methods of using one or more of the downhole oilfield tubular apparatus disclosed herein wherein the injected fluids or gases includes carbon dioxide.

Also disclosed are methods of using one or more of the downhole oilfield tubular apparatus disclosed herein that includes injecting fluids or gases into the apparatus for disposing of fluids or gases.

Also disclosed are methods of using one or more of the downhole oilfield tubular apparatus disclosed herein that includes removing hydrocarbons from a well by passing the hydrocarbons through the apparatus such that the hydrocarbons make contact with the liner.

Also disclosed are methods of using one or more of the downhole oilfield tubular apparatus disclosed herein that includes injecting well fluids through the apparatus and into a well to alter the underground formation around the well.

At least one specific embodiment of a downhole oilfield tubular apparatus disclosed herein comprises (includes): a structure that is configured to be vertically disposed in a well and has a tubular borehole with an inner surface; and a liner disposed inside the tubular borehole, wherein the liner comprises three or more layers and the downhole oilfield tubular apparatus is selected from the group consisting of: (a) a rod pumping system; (b) a progressive cavity pumping system; (c) a downhole reservoir pressure well that includes a plurality of tubing sections; (d) a plunger lifted system; (e) a submersible pump; (f) a gas lifted system that includes a downhole mandrel; (g) a string of injection well tubing in an enhanced oil recovery well; and (h) a string of injection well tubing in a disposal well.

For a downhole reservoir pressure well being openly produced to facilitate lifting fluids, solids or gases to the surface, a method includes using a string of tubing comprising a plurality of tubing sections each having a bore and an inside diameter wherein the improved method comprises using tubing sections having one or more of the liners disclosed herein disposed within said bore of said tubing sections to eliminate contact between said produced fluids, solids and gases and said tubing string to eliminate corrosive or erosive interactions between them.

For a plunger lifted system, a method includes using a cylindrical object to raise the fluids to the surface, a receiver for the plunger cylinder, and a string of tubing comprising of a plurality of tubing sections each having a bore and an inside diameter wherein the improved. method comprises using tubing sections having one or more of the liners disclosed herein disposed within said bore of said tubing sections to eliminate contact between said produced fluids and the cylinder and said tubing string to eliminate corrosive or erosive interactions between them when the plunger is deployed.

For a submersible pump commonly referred to as a jet pump, hydraulic pump or electric submersible pump, a method includes using a downhole impeller driven pump and a string of tubing comprising a plurality of tubing sections each having a bore and an inside diameter wherein the improved method comprises using tubing sections having one or more of the liners disclosed herein disposed within said bore of said tubing sections to eliminate contact between said produced fluids, solids and gasses and said tubing string to eliminate corrosive or erosive interactions between them.

For gas lifted methods, a method includes using a set of downhole mandrels deployed within the tubing string to inject gas into the produced fluid and a string of tubing comprising a plurality of tubing sections each having a bore and an inside diameter wherein the improved method comprises using tubing sections having one or more of the liners disclosed herein disposed within said bore of said tubing sections to eliminate contact between said produced fluids, solids and gases and said tubing string to eliminate corrosive or erosive interactions between them.

To inject fluids or gases for enhanced recovery of natural resources in downhole formations or for the purpose of disposing of the transported fluids or gases, a method includes using a string of tubing comprising a plurality of tubing sections each having a bore and an inside diameter wherein the improved method comprises using tubing sections having one or more of the liners disclosed herein disposed within said bore of said tubing sections to eliminate contact between said injected fluids, solids and gases and said tubing string to eliminate corrosive or erosive interactions between them. The injected fluids or gases may include carbon dioxide ($CO_2$) or aqueous (water) materials For a string of tubing comprising of a plurality of tubing sections each having a bore and an inside diameter, an improved method comprises using tubing sections having one or more of the liners disclosed herein disposed within said bore of said tubing sections to reduce frictional forces in such operations and increase the operating efficiency of such wells by reducing the surface roughness of said tubing and reducing the coefficient of friction between the said liner and materials in contact with the liner.

For a string of tubing comprising a plurality of tubing sections each having a bore and an inside diameter, an improved method comprises using tubing sections having one or more of the liners disclosed herein disposed within said bore of said tubing sections to reduce the adherence of surface deposits such as scale or paraffin that restrict the inside diameter of the pipe and constrict the flow capacity of the tubing string.

For a string of tubing comprising a plurality of tubing sections each having a bore and an inside diameter, an improved method compromises using tubing sections having liners disposed within said bore of said tubing sections to reduce the inside diameter of the tubing string with one or more of the liners disclosed herein to increase the velocity of the transported material. This is commonly referred to as a velocity string.

C. Liners

The liners disclosed herein are preferably formed of polymers and preferably have two or more different layers. A propylene homopolymer is a favored liner polymer. In the context of downhole oilfield tubulars, an improved result has been discovered when using a liner made of a polypropylene homopolymer, representing a decided improvement over a liner made of another type of polyolefin such as polyethylene. At least one improved result is an improvement in resistance to degradation by aromatic compounds, which compounds are often part of the hydrocarbons that make contact with the liner during operation of the apparatus. Such resistance to degradation is particularly enhanced at higher temperatures.

Examples of polymers for the liners disclosed herein include polypropylene, consist entirely of polypropylene, or consist essentially of polypropylene, where the polypropylene can be, but is not limited to: nucleated polypropylene; impact copolymer grade polypropylene; homopolymer grade polypropylene; fractional melt grade polypropylene; metallocene catalyzed polypropylene; random copolymer polypropylene; atactic polypropylene; isotactic polypropylene; and syndiotactic polypropylene. Liner polymers can also be blends, alloys, filled or reinforced polypropylene, polyethylene containing polyolefins, heterophasic copolymers, other thermoplastics coextruded with polypropylene, reactor made thermoplastic polyolefins, or any polyolefins containing nanocomposites or other additives to control diffusion rates of compounds through the liner wall.

The layers are typically coextruded through a specially designed extrusion die head using multiple extruders. The melted polymer layers are then cooled into one continuous seamless tube.

By way of example only, certain layers, such as the friction and wear reducing layers, may comprise nucleated polypropylene; polyolefins containing nanocomposites or other additives to control diffusion rates; impact copolymer grade polypropylene; homopolymer grade polypropylene; heterophasic copolymers; fractional melt grade polypropylene; other thermoplastics coextruded with polypropylene; reactor made thermoplastic polyolefins; metallocene catalyzed polypropylenes; random copolymer polypropylenes; blends, alloys, filled or reinforced polypropylene or polyethylene containing other polyolefins and structural reinforcement. In addition, additives may be included in the polymer to increase the lubricity of the liner material and decrease the coefficient of friction of the product.

The gas diffusion barrier may comprise these or other polymers, organic or inorganic materials, or metals. In some embodiments, this barrier is chosen to reduce or eliminate the permeation of carbon dioxide through liners utilized in $CO_2$ floods and WAG (water-alternating-gas) injection systems for oil production enhanced recovery operations.

In some specific embodiments, the friction and wear reducing layer and the diffusion barrier layer are chemically bonded to one another with 2,5-furandione, which in one embodiment may be part of a separate adhesive layer disposed between the friction and wear reducing layer and the diffusion barrier layer; or in another embodiment may be included to either the friction and wear reducing layer or the diffusion barrier layer as an adhesive additive. Besides 2,5-furandione, other similar additives or combination(s) of additives may be used. In other embodiments, the layers may be bonded together by any acceptable adhesive as is known in the art, including use of commercially available adhesives. For example, in certain embodiments, an acceptable adhesive may comprise a copolymer. It is also envisioned that the friction wear reducing layer and the diffusion barrier need not be directly bonded together. There may be intermediate layers between the two. Additionally, there may be layers radially outward or inward of the diffusion barrier. By way of example only, the diffusion barrier may be sandwiched between the friction and wear reducing layer and a third layer. The third layer may be of the same or different material as the friction and wear reducing layer.

Internal corrosion by corrosive fluids and gases in all types of production and injection wells can be controlled with the present invention, through the use of certain polyolefins such as polypropylene and methods for their application to the tubing, it being understood that each of the wells include some form of tubing.

A plurality of different types of wells can be modified, including free flowing, reciprocating rod pumped, plunger lifted, gas lifted, submersible pumped, progressive cavity pumped, hydraulically lifted, source, injection or disposal wells that have downhole tubulars may have their performance increased. In all of these wells, a tubing string is employed to convey materials either into or out of a downhole reservoir. One improved method and apparatus comprises using tubing sections having certain abrasion and corrosion resistant polyolefin liners disposed within the inside bore of the tubing to eliminate contact between the moving parts of the artificial lift systems and corrosive fluids with the inside bore of the tubing. Polyolefin liners, such as polypropylene, have a coefficient of friction that is superior to the coefficient of friction of steel tubing alone. Further, when polyolefin liners are wetted by fluid, susceptibility to abrasion is further reduced. In addition to the substantial benefits of protecting the tubing string on a rod pumped well from the detrimental effects caused by reciprocating or rotating rods, certain polyolefin liners mitigate the effects of corrosive agents such as salt water, dissolved oxygen, carbon dioxide, hydrogen sulfide, and other corrosive elements commonly present in injection and production wells. The liner also serves as a barrier that will not allow bacteria that cause microbiologically influenced corrosion to occur.

Also disclosed herein are methods and apparatus for reducing or eliminating the mechanical and/or chemical wear, fatigue, and failure on tubular goods. The methods comprise disposing a liner along at least a portion of the tubular good. The liner may decrease friction, thereby decreasing mechanical wear as well as reducing the amount of energy necessary to operate the mechanical tool or pump the abrasive fluid. In addition, the liner may also comprise a material which is resistant to particular chemicals or a barrier to particular chemicals, thereby decreasing or eliminating contact between the chemicals and the tubular good and decreasing or eliminating the wear or corrosion caused by those chemicals.

Disclosed herein is a tubular good comprising: an outer pipe layer; and an inner layer, wherein the inner layer comprises a diffusion barrier and a friction reducing layer, and wherein the diffusion barrier is disposed radially outward of the friction reducing layer.

Disclosed herein is a tubular good which further comprises an adhesive layer disposed between the diffusion barrier and the friction reducing layer.

Disclosed herein is a tubular good Wherein the tubular good is an oil country tubular good.

Disclosed herein is a tubular good wherein the tubular good is a flowline tubular good.

A tubular good may be provided wherein the diffusion barrier comprises a vinyl alcohol.

A tubular good may be provided wherein 2,5-furandione is used as an additive to bond the diffusion barrier and the friction reducing layer.

A tubular good may be provided further comprising a third layer radially outward from the diffusion barrier and radially inward from the outer tubular layer.

A method of preparing a tubular good is provided, the method comprising: providing an outer tubular layer; providing an inner tubular layer; wherein the inner tubular layer comprises a chemical barrier and a wear reducing layer; wherein the chemical barrier is disposed radially outward from the wear reducing layer; and inserting the inner tubular layer into the outer tubular layer.

One or more of the methods disclosed herein can further comprise providing an adhesive layer disposed between the chemical barrier and the wear reducing layer, wherein the adhesive layer bonds the chemical barrier to the wear reducing layer.

In one of more of the methods, a wear reducing layer comprises a polyolefin, or a polypropylene, or a polyethylene, or a copolymer, or a homopolymer.

Also disclosed herein is a tubular good liner comprising: a wear barrier and a diffusion barrier; wherein the diffusion barrier is disposed radially outside of the wear barrier; and wherein the diffusion barrier is bonded to the wear barrier.

Also described here is a tubular good liner comprising: a means for reducing friction; a means for preventing diffusion of a compound; and a means for bonding the means for reducing to the means for preventing; wherein the means for preventing is disposed radially outward from the means for reducing.

The tubular good that includes a tubular good liner can be a flowline tubular good; or a slurry transport line; or a solution mining tubular good.

In one or more of the tubular good liners, the tubular good houses a reciprocating member. In others, the tubular good can contain a rotating member.

In one or more of the methods that uses tubular good liners, the tubular good transports abrasive material.

Also disclosed herein is a method for producing well fluids including: providing a rod pumping system comprising at least one sucker rod disposed within a string of tubing which. extends into said well, the string of tubing comprising at least one tubing section having a bore and an inside diameter; a down hole pump operably connected to the at least one sucker rod; and means for reciprocating the at least one sucker rod; wherein a liner comprising polypropylene is disposed within the bore of the tubing to eliminate or reduce contact between the at least one sucker rod and the tubing string.

4. Specific Embodiments in the Figures

Referring now to FIG. 1, a simplified cross section of cylindrical liner having a scrolled configuration is depicted. The cylindrical liner preferably comprises at least two sheet layers that are scrolled together to form a cylindrical liner with a scrolled configuration. In the embodiment depicted in the figure, two sheet layers, a gas diffusion barrier sheet layer 14 and a gas diffusion sheet layer 12, are scrolled together starting from opposite points (180° apart) to form an approximately cylindrical liner comprising three scroll layers across every radii. Each sheet layer may travel 540° relative to a center axis. The two sheet layers may form scroll layers that are approximately co-axial. The sheet layers need not span the same distance nor be the same size. The axial center of the cylindrical liner may comprise a hollow borehole 16 capable of transporting fluids. The scroll layers may be positioned such that each sheet layer has a portion that is positioned radially inward from the other sheet layer, and each sheet layer has a portion that is positioned radially outward from the other sheet layer. The scroll layers may be positioned such that a portion of each sheet layer is sandwiched between two scroll layers of the other sheet layer.

Referring now to FIG. 2, an inset indicated from FIG. 1 is depicted. This inset depicts illustrative movement of gas molecules 18 through a cylindrical liner having a scrolled configuration. The gas molecules 18 may move freely within the gas diffusion layer 12, but are inhibited from passing (or do not pass at all) through the gas diffusion barrier 14. Pressure in the interior borehole 16 of the liner may cause gas molecules 18 to travel towards the exterior of the liner. Gas molecules 18 may travel in a radially outward direction until encountering a gas diffusion barrier 14. Gas molecules may then be directed to travel circumferentially along the gas diffusion barrier 14. The gas molecules 18 may travel within a gas diffusion layer 12 while travelling circumferentially along the gas diffusion barrier 14. The gas molecules may also travel in a radially outward direction within the gas diffusion layer 12 until encountering a gas diffusion barrier 14, where they should be directed to travel circumferentially along the gas diffusion barrier 14. The gas molecules 18 should be directed circumferentially because the tangent of the gas diffusion barrier is not perpendicular to the direction of the pressure force from the interior borehole of the liner, which is radially outward. Upon reaching the gas diffusion barrier, the gas molecules should travel circumferentially along the gas diffusion barrier, because a force directed in a non-perpendicular direction to an object on a surface will tend to cause the object to move along the surface. Some of the gas molecules 18 may travel circumferentially from a minimum of 10° up to a maximum of 2160° (6 rotations) or even more, but preferably from 90° to 1080° (3 rotations). The gas molecules 18 preferably reach the outermost end of the gas diffusion barrier 14 sheet layer and then exit the liner. There may be another friction and wear reducing layer radially outward from the scroll layers that the gas molecules may then travel within after circumferentially traversing the scroll layers (example not pictured). There may be another friction and wear reducing layer radially inward from the scroll layers that the gas molecules may first travel within before circumferentially traversing the scroll layers (example not pictured).

Referring now to FIG. 3, a cross section of a cylindrical liner 23 with a non-scrolled configuration positioned within a tubular member 20 is depicted for comparison purposes. That liner may comprise a friction and wear reducing layer positioned within a tubular member 20. Pressure in the interior borehole 16 of the liner 23 may cause gas molecules 18 to travel towards the exterior of the liner 23. Because no gas diffusion barrier is in place, the gas molecules 18 are capable of travelling radially through the friction and wear reducing layer until they exit the liner 23.

Referring now to FIG. 4, a cross section of a cylindrical liner 23 with a non-scrolled configuration positioned within a tubular member 20 is depicted for comparison purposes. Gas-build up on the outside of the liner 23 due to gas molecules 18 travelling to the exterior of the liner (see FIG. 3) may cause the pressure on the outside of the liner 23 to exceed the interior pressure and the hoop strength of the liner 23, causing the liner 23 to become structurally compromised within the tubular member 20. It has been discovered that, during a typical oil or gas production operation, gas molecules (e.g., $CO_2$) are present in the oil or gas that is flowing in an upward axial direction through the wellbore. In addition to flowing axially, those gas molecules also migrate radially outwardly through the liner. With a liner that lacks a scrolled configuration, the inventors have discovered that, if the liner includes an interior diffusion layer (which permits diffusion of the gas molecules) and an external gas diffusion barrier layer (that inhibits diffusion of the gas molecules) then the outwardly migrating gas molecules will eventually (over time) tend to build up and collect at one or more points between the outer surface of the gas diffusion barrier and inner surface of gas diffusion barrier layer. The resulting formation of a gas pocket may compromise the structure of the liner (example not pictured).

Referring now to FIG. 5, there is depicted a cylindrical liner for a tubular member comprising friction and wear reducing outer layer 24, friction and wear reducing inner layer 22, diffusion barrier 14, and gas diffusion layer 12. A hollow center borehole 16 capable of transporting fluids is also depicted. The diffusion barrier 14 and gas diffusion layer 12 may be scrolled to give the cylindrical liner a scrolled configuration. The inner layer 22 and outer layer 24 may be non-scrolled with the diffusion barrier 14 and gas diffusion layer 12. The cylindrical liner may be positioned within a metal tubular good such as an OCTG, a flowline tubular good, or a solution mining or slurry transport line. The cylindrical liner may include elements 22, 24, 12 and 14. The cylindrical liner may also comprise an adhesive layer capable of bonding the diffusion barrier 14 and gas diffusion layer 12. Friction and wear reducing inner layer 22 may comprise, by way of example only, polyethylene or polypropylene. Layers 22 and 24 may or may not consist of the same material. The diffusion barrier 14 may comprise, by way of example only, a vinyl alcohol such as polyvinyl alcohol. Inner layer 22 and outer layer 24 may be bonded to diffusion barrier 14 and gas diffusion layer 12 by any method as would be appreciated by one of skill in the art. By way of example only, inner layer 22 may be bonded to diffusion barrier 14 and gas diffusion layer 12 by an adhesive layer, and outer layer 24 may be bonded to diffusion barrier 14 and gas diffusion layer 12 by an adhesive layer. Diffusion barrier 14 and gas diffusion layer 12 may be bonded by any method as would be appreciated by one of skill in the art (e.g. an adhesive layer). The aforementioned adhesive layers may be, but are not necessarily, the same adhesive. The adhesive layers may comprise any acceptable polymer adhesive as is known in the art, such as copolymers.

Inner layer 22 or outer layer 24 may be bonded to diffusion harrier 14 and gas diffusion layer 12 by the addition of one or more additives to the layers such as, by way of example only, 2,5-furandione. Diffusion barrier 14 and gas diffusion layer 12 may be bonded by the addition of one or more additives to the layers such as, by way of example only, 2,5-furandione. When added to the layers, the additive may cause the layers to become bonded together without the need for additional adhesives.

Figure 6:
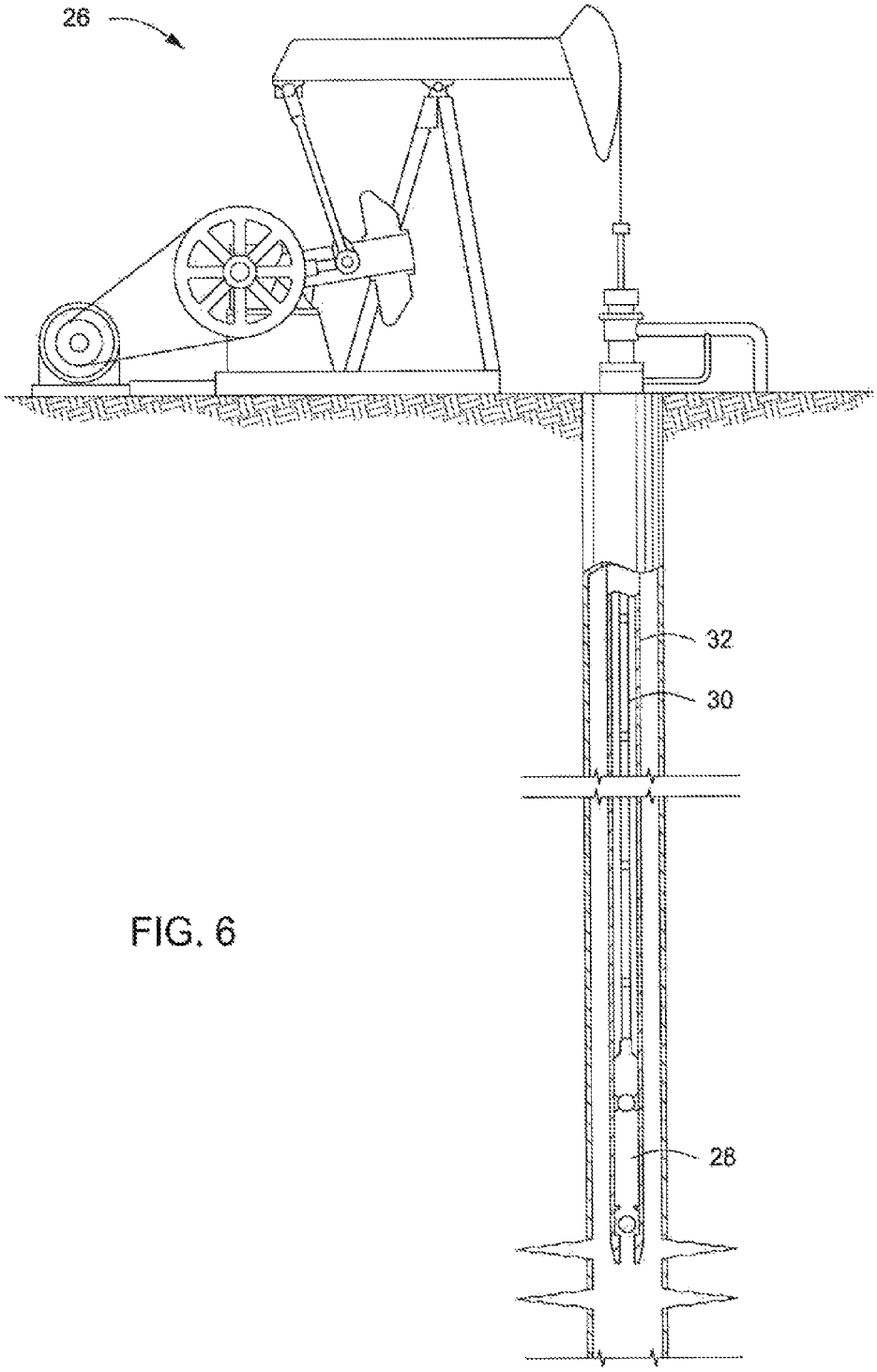
FIG. 6 is a schematic drawing of a rod pumping system.

A rod pumping system 26 (see FIG. 6) commonly referred to as a beam pumping well may include a plurality of sucker rods 30 (see FIG. 6) disposed within a string of tubing 32 which extends into said well, said string of tubing comprising a plurality of tubing sections each having a bore and an inside diameter; a down hole pump 28 operably connected to said sucker rods 30; and means for reciprocating said sucker rods wherein the improved method comprises using tubing sections having liners disposed within said bore of said tubing sections to eliminate contact between the sucker rods and the tubing string when the sucker rods are being reciprocated.

A rotating rod pumping system, commonly referred to as a progressive cavity pumping system, uses a plurality of sucker rods disposed within a string of tubing which extends into said well, the string of tubing comprising a plurality of tubing sections each having a bore and an inside diameter; a down hole pump operably connected to the sucker rods; and means for rotating the sucker rods wherein the improved method comprises using tubing sections having one or more of the liners disclosed herein disposed within the bore of said tubing sections to eliminate contact between the sucker rods and the tubing string when the sucker rods are being rotated.

Figure 7:
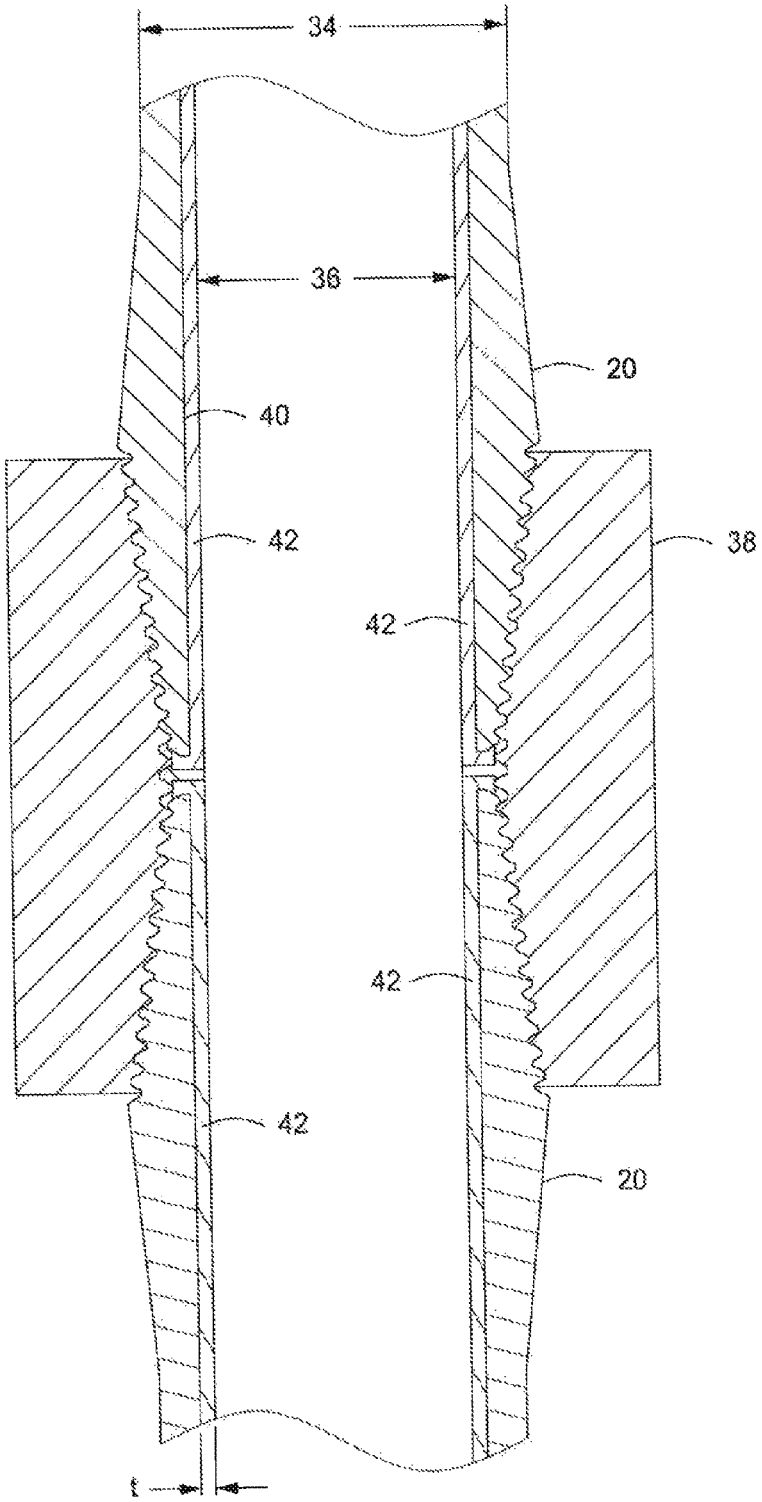
FIG. 7 is a cut-away side view of coupled and lined tubing joints.

Referring now to FIG. 7, there is shown metal tubular member 20, coupling 38, and liner 42. Two metal tubular members 20, each having an inner diameter 36 and outer diameter 34, are connected together by coupling 38. A liner 42 (a specific embodiment of which is shown in detail in FIG. 5) is disposed in adjacent contact with the inner surface 40 of each tubular member 20. Liner 42 may be a multilayer system comprising both a friction and wear resistant material and a diffusion barrier. In some specific embodiments, the liner 42 can be a multilayer system with a scrolled configuration. In some specific embodiments, where gas diffusion is of minimal or no concern, liner 42 may comprise a layer comprising only a friction and wear resistant material such as polypropylene or polyethylene with no diffusion barrier being present. That is, a specific embodiment includes a liner having a single layer that includes polypropylene or polyethylene.

The liner 42 may be disposed within the tubing 20 by any one of several methods known in the art. One method of disposing the liner within the tubing bore is to provide a polymer liner having an outside diameter which is slightly greater than or equal to the inner diameter of the tubing section pipe having an outside diameter larger than the internal diameter of the tubing. Reduce the outside of the liner and insert the reduced diameter liner within the tubing. After the liner is in place, it will attempt to substantially return to its original shape and will become secured within the tubing section. Numerous methods of reducing the outside diameter of the liner for insertion into a tubing section are available. For example, rollers may be used to mechanically reduce the outside diameter of the liner by the desired amount and to push the liner into the tubing joint. Other methods include pulling the liner through a sizing sleeve or orifice and inserting the reduced diameter liner into place in the tubing. One method of disposing the polymer liners within the tubing sections includes providing a liner having an initial outside diameter similar to or larger than the inner diameter of the tubing, reducing the outer diameter of the liner by mechanical means and inserting the liner into the tubing bore. The ends of the polymer liner may then be softened using a heat source and formed around the end of the external pipe thread on the metal pipe. In some cases, the ends may be reinforced for additional structural integrity. The ends may then be joined onto a coupling (with or without an internal coating or corrosion resistant insert) used to join each stick of lined pipe. The process ultimately provides a one-piece seamless liner in each joint that is mechanically bonded to the metal pipe ID. The wall thickness of the claimed liners is preferably between about 2 and 50 millimeters, including a lower range of from at least 2, 4, 6, or 10 millimeters to an upper range of up to 10, 15, 25, 40, or 50 millimeters. The diameter of the claimed liners may be between about 20 and 700 millimeters or greater, including a lower range of from at least 30, 50, or 100 millimeters to an upper range of up to 100, 250, 500, or 700 millimeters. In the embodiments shown in FIG. 7, the thickness "t" of the liner 42 is about 4 millimeters. The liner may be exposed to temperatures ranging from 10 degrees Celsius to 100 degrees Celsius or more, including a lower range of at least 10, 15, 25, 40, or 50 degrees Celsius and up to an upper range of from 50, 60, 75, 90, or 100 degrees Celsius.

What is claimed is:

1. A method for providing a string of tubing for installation in a well, which method comprises installing a string of tubing within a wellbore, wherein:

the string of tubing comprises a plurality of elongated tubular members and at least one cylindrical liner comprising a polymer;

at least one of the plurality of elongated tubular members includes a cylindrical wall having an inner surface and an outer surface;

the cylindrical liner has an outer surface that is disposed in adjacent contact with the inner surface of the elongated tubular member;

the cylindrical liner has an inner surface that defines the tubing borehole;

the cylindrical liner has a scrolled configuration; and the cylindrical liner includes at least one sheet layer that is scrolled to form the scrolled configuration and a non-scrolled, cylindrical layer positioned as the radially innermost layer of the cylindrical liner.

2. A method for providing a string of tubing for in installation in a well which method comprises installing a string of tubing within a wellbore, wherein:

the string of tubing comprises a plurality of elongated tubular members and at least one cylindrical liner comprising a polymer;

at least one of the plurality of elongated tubular members includes a cylindrical wall having an inner surface and an outer surface;

the cylindrical liner has an outer surface that is disposed in adjacent contact with the inner surface of the elongated tubular member;

the cylindrical liner has an inner surface that defines the tubing borehole;

the cylindrical liner has a scrolled configuration; and the cylindrical liner includes at least one sheet layer that is scrolled to form the scrolled configuration and a non-scrolled, cylindrical layer positioned as the radially outermost layer of the cylindrical liner.

* * * * *

UNITED STATES PATENT AND TRADEMARK OFFICE

CERTIFICATE OF CORRECTION

PATENT NO. : 8,997,880 B2
APPLICATION NO. : 13/362368
DATED : April 7, 2015
INVENTOR(S) : Robert H. Davis et al.

It is certified that error appears in the above-identified patent and that said Letters Patent is hereby corrected as shown below:

In the Claims

Claim 2, line 1 (Col. 18, line 45) - omit the word "in'" between the phrases "tubing for" and "installation in a well."

Claim 2, line 2 (Col. 18, line 46) - add a "," between the words "well" and "which."

Signed and Sealed this
Eighteenth Day of August, 2015

Michelle K. Lee

Michelle K. Lee
*Director of the United States Patent and Trademark Office*